US010822829B1

(12) United States Patent
Lu et al.

(10) Patent No.: US 10,822,829 B1
(45) Date of Patent: Nov. 3, 2020

(54) FOLDING CANOPY WITH CENTRAL LOCKING MECHANISM

(71) Applicant: Linhai Zhenyi Arts & Crafts Co., Ltd., Zhejiang (CN)

(72) Inventors: Nengxiao Lu, Zhejiang (CN); Bin Wang, Zhejiang (CN)

(73) Assignee: Linhai Zhenyi Arts & Crafts Co., Ltd., Zhejiang (CN)

( * ) Notice: Subject to any disclaimer, the term of this patent is extended or adjusted under 35 U.S.C. 154(b) by 0 days.

(21) Appl. No.: 16/574,095

(22) Filed: Sep. 18, 2019

(30) Foreign Application Priority Data

Jun. 26, 2019 (CN) ..... 2019 1 0561755
Jun. 26, 2019 (CN) ..... 2019 2 0978933 U

(51) Int. Cl.
*E04H 15/48* (2006.01)

(52) U.S. Cl.
CPC ..... *E04H 15/48* (2013.01)

(58) Field of Classification Search
CPC ..... E04H 15/44; E04H 15/48; E04H 15/50
USPC ..... 135/114, 135
See application file for complete search history.

(56) References Cited

U.S. PATENT DOCUMENTS 1,845,143 A * 2/1932 Friesner ..... E04H 15/60 403/105
2,090,550 A * 8/1937 Pilblad ..... H04R 1/08 248/410
3,734,441 A * 5/1973 Lux ..... F16B 2/246 248/354.1
4,256,129 A * 3/1981 Gilsenan ..... E04H 15/50 135/143
5,108,066 A * 4/1992 Lundstrom ..... A63B 21/0728 24/524
5,444,946 A * 8/1995 Zeigler ..... E04H 15/50 52/86
6,345,639 B2 * 2/2002 Rousselle ..... E04H 15/28 135/128
6,869,112 B2 * 3/2005 Guidetti ..... F16B 2/246 280/823
7,422,026 B2 * 9/2008 Kim ..... E04H 15/50 135/120.2
7,607,447 B1 * 10/2009 Han ..... E04H 15/28 135/135
10,246,898 B2 * 4/2019 Jin ..... E04H 15/50
10,273,710 B2 * 4/2019 Yang ..... E04H 15/44
10,273,711 B2 * 4/2019 Song ..... E04H 15/28
2016/0289999 A1 * 10/2016 Choi ..... E04H 15/32
2019/0234102 A1 * 8/2019 Lu ..... E04H 15/46

* cited by examiner

*Primary Examiner* — Noah Chandler Hawk
(74) *Attorney, Agent, or Firm* — JCIP Global Inc.

(57) ABSTRACT

The present invention relates to a folding canopy with central locking mechanism, including a central locking mechanism including a top disk, a lower disk and a lock lever. The lower disk includes a locking unit for engaging with the lock lever, and the locking unit includes a lock plate and an elastic member. The lock plate is provided therein with a locking hole, and the lock lever is used to penetrate the locking hole. The elastic member is used for tilting the locking hole in the lock plate to a hole-tilted position. When the locking hole is tilted to the hole-tilted position and a wall of the locking hole is in frictional contact with a side wall of the lock lever, the central locking mechanism completes locking.

13 Claims, 9 Drawing Sheets

FOLDING CANOPY WITH CENTRAL LOCKING MECHANISM

CROSS-REFERENCE TO RELATED APPLICATION

This application claims the priority benefit of China application serial no. 201920978933.6, filed on Jun. 26, 2019, and China application serial no. 201910561755.1, filed on Jun. 26, 2019. The entirety of each of the above-mentioned patent applications is hereby incorporated by reference herein and made a part of this specification.

FIELD OF THE INVENTION

The present invention relates to the technical field of folding canopy, in particular, to a folding canopy with central locking mechanism.

BACKGROUND

The alias of the folding tent is an advertising tent and an awning. It can be used for outdoor exhibitions and product promotion, celebration evenings, exhibitions, tourism, leisure, field work, food stalls. It can also be used for song and dance evenings and other temporary activities, as well as long-term leisure facilities in the park tourist resort scenic area. The folding tent can be unfolded when in use, can be folded and shrunk when not in use, having the advantages of shielding sun and rain, and being convenient to carry, so as to be widely used in daily life.

Folding tents are generally built from folding tent skeletons and tent fabrics. The locking buckles of existing folding tents are usually located on their leg tubes, and fixing the surrounding leg tubes will open and support the entire folding tent. However, when fixing the leg tubes of the folding tent, it takes a lot of people to work together to lift the folding tent, and as the size of the tent grows larger, the number of people needed will gradually increase.

To this end, No. CN108026736A discloses a central lock comprising a central rod, a central top cap fixed at one end of the central rod, and a central bottom cap detachably connected to the other end of the central rod. The central bottom cap houses a locking member movable radially back and forth along the central rod, and the locking member is provided with a first through hole through which the central rod can pass. The end of the central rod is provided with a recess and a latching portion at a lower end of the recess. When the central lock is in a locked state, a portion of an inner wall of the first through hole on the locking member is engaged with the recess of the central rod, and an upper end surface of the latching portion abuts against a lower end surface of the locking member. When the central lock is in an unlocked state, the inner wall of the first through hole on the locking member is disengaged from the recess, and the latching portion can pass through the first through hole.

The invention patent of Publication No. CN206888665U discloses a deployment fixture for folding tent and a folding tent. The deployment fixture of the folding tent comprises a support rod, a base and a telescopic guide rod. One end of the support rod is hinged to a top skeleton rod of the folding tent, and the other end of the support rod is hinged to the base. One end of the guide rod is connected to a top connecting seat of the folding tent, and the other end of the guide rod is connected to the base. One end of the top skeleton rod is hinged to the top connecting base. The base and the guide rod are provided with locking mechanisms that cooperates with each other, and the base and the guide rod are locked by the locking mechanism when the folding tent is deployed and fixed. The locking mechanism includes an engaging port disposed on a sidewall of the guide rod, and the base is provided with a button. The button is provided with a tongue for engaging with the engaging port, and the button is connected with an elastic member for applying an elastic force to the button to insert the tongue into the engaging port.

In above structure, whether it employs the engaging cooperation between the recess and lock or the abutting cooperation between the tongue and the engaging port, it is fixed by engagement; the unlocking is realized by detachment through engagement, and the locking cooperation is essentially realized by a structure of an engaging block and a notch. Therefore, the locking must be realized by providing a notch on the lock lever. However, for this kind of design of recess structure, the locking of the engaging piece and the notch usually does not achieve a clearance-free fit, causing the locking mechanism in the central lock to have a certain gap during the cooperation process, so that the lock lever usually shakes, which affects the use effect, thereby affecting the stability of the entire folding canopy. In addition, the latch structure of the above structure is designed such that the locking position of the lock lever is fixed, so that the limitless locking function cannot be realized.

SUMMARY

The purpose of the present invention is to a folding canopy with central locking mechanism for solving the above technical problem, which does not need a design of recess, may realize locking without gap, and has the characteristics of strong locking stability, simple structure and limitless locking.

The technical problem solved by the present invention may be implemented by the following technical solutions:

A folding canopy with central locking mechanism, comprising a central locking mechanism including a top disk, a lower disk and a lock lever, the lower disk including a locking unit for engaging with the lock lever, characterized in that the locking unit includes a lock plate and an elastic member; the lock plate is provided therein with a locking hole, and the lock lever is used to penetrate the locking hole; the elastic member is used for tilting the locking hole in the lock plate to a hole-tilted position; and when the locking hole is tilted to the hole-tilted position and a wall of the locking hole is in frictional contact with a side wall of the lock lever, the central locking mechanism completes locking.

The lock plate includes a button portion, a lock plate body, and a linkage portion; the button portion is wholly or partially located outside the lower disk, and the locking hole is located on the lock plate body; one end of the elastic member is used for abutting against the lock plate body, and the other end is cooperatively mounted to the lower disk; the linkage portion is used for cooperatively mounting with the lower disk.

When the lock plate is not subjected to an external force, the lock plate body is abutted by the elastic member and is in a tilted state.

When the locking unit is in an unlocked state, the locking hole is centered close to or overlaps a central axis of the lock lever; when the locking unit is in a locked state, the locking hole is centered away from the central axis of the lock lever.

The lower disk further includes a first lower disk unit and a second lower disk unit; the first lower disk unit and the second lower disk unit are combined and assembled to form a mounting cavity and a button window; the mounting cavity is used for mounting to cooperate with the locking unit, and the button portion is located at the button window and extends to the outside; the button portion may be pulled up and down at the button window.

The button portion may drive the lock plate body to move in the mounting cavity.

The first lower disk unit is provided with a lock lever guiding hole, and the lock lever guiding hole is provided with a trumpet-shaped guiding hole wall, the lock lever being used for penetrating the lock lever guiding hole and extending downward.

The second lower disk unit is provided with a linkage groove and a mounting seat, the linkage groove is used for cooperatively mounting with the linkage portion, and the mounting seat is used for cooperatively mounting with the elastic member.

The second lower disk unit is provided therein with a lock lever seat, and the lock lever seat is used for accommodating an end of the lock lever.

The second lower disk unit is provided a pull ring at the bottom.

Compared with the prior art, the present invention has the following outstanding advantages and effects: the present invention adopts the design of the slotless lock lever structure, and utilizes the tilting of the lock plate to drive the locking hole to tilt to a hole-tilted position, so that the lock lever can be in frictional contact with the hole-tilted position, and the limitless locking can be realized by changing the force relationship between the lock lever and the locking hole; the structure has the characteristics of convenient operation, simple structure and stable locking.

The features of the present invention can be clearly understood from the description of the drawings and the detailed description of the preferred embodiments.

Figure 1:
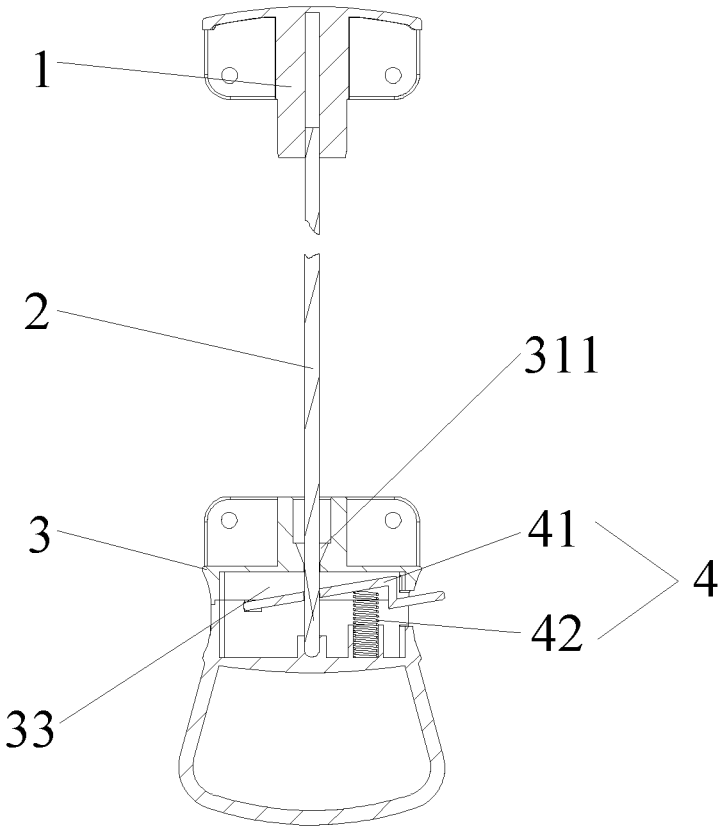
FIG. 1 is a cross-sectional view showing the overall structure of the present invention.
Figure 2:
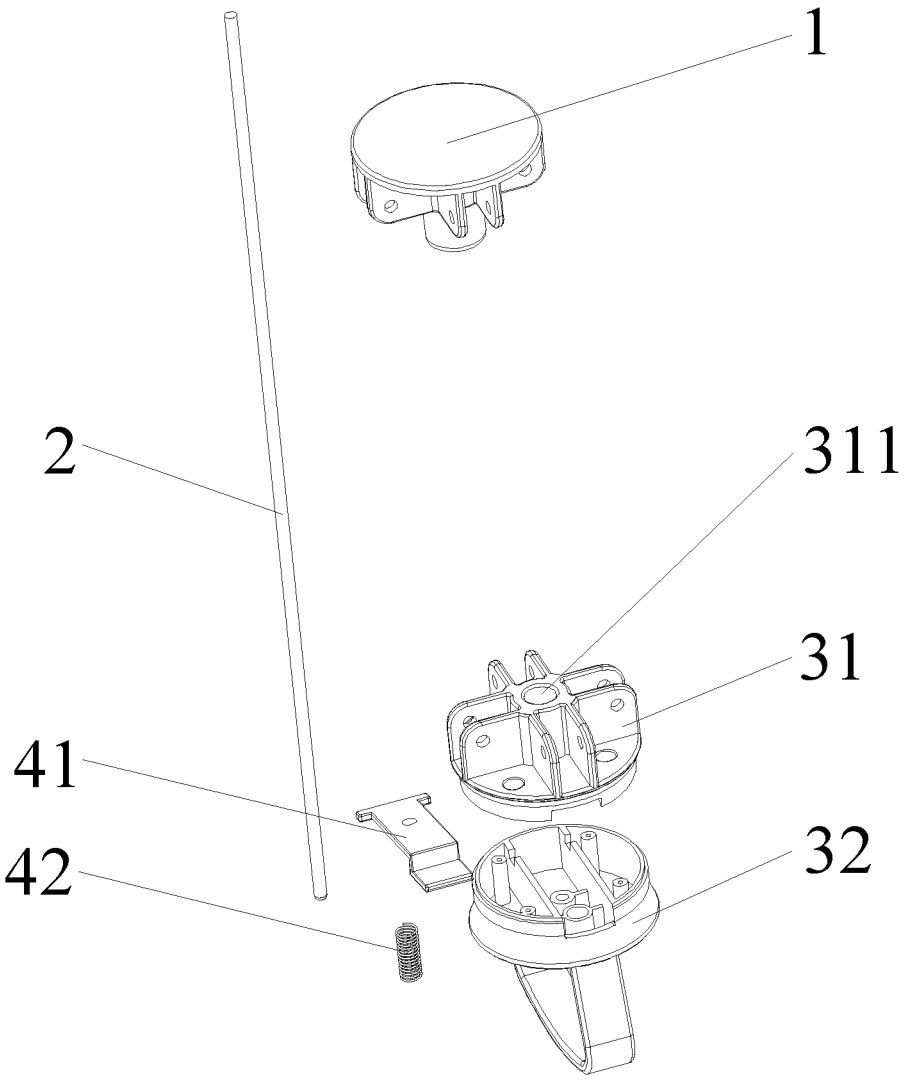
FIG. 2 is a view showing the overall exploded structure of the present invention.
Figure 3:
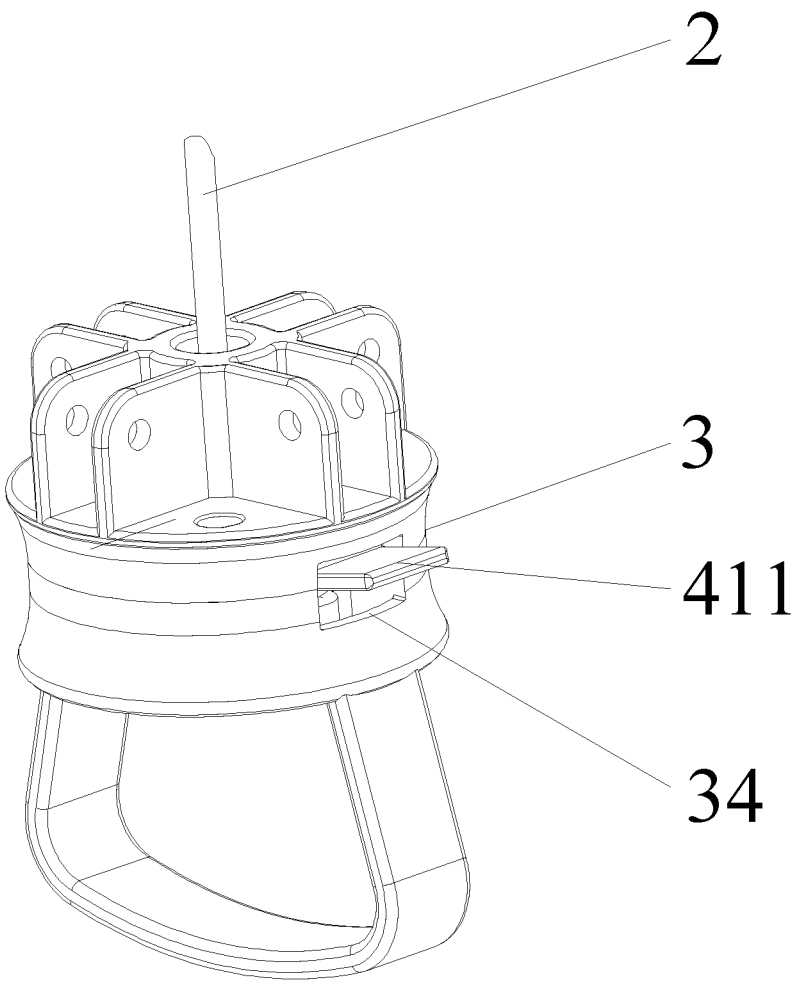
FIG. 3 is a structural view showing the installation of the lower disk and the locking unit of the present invention.
Figure 4:
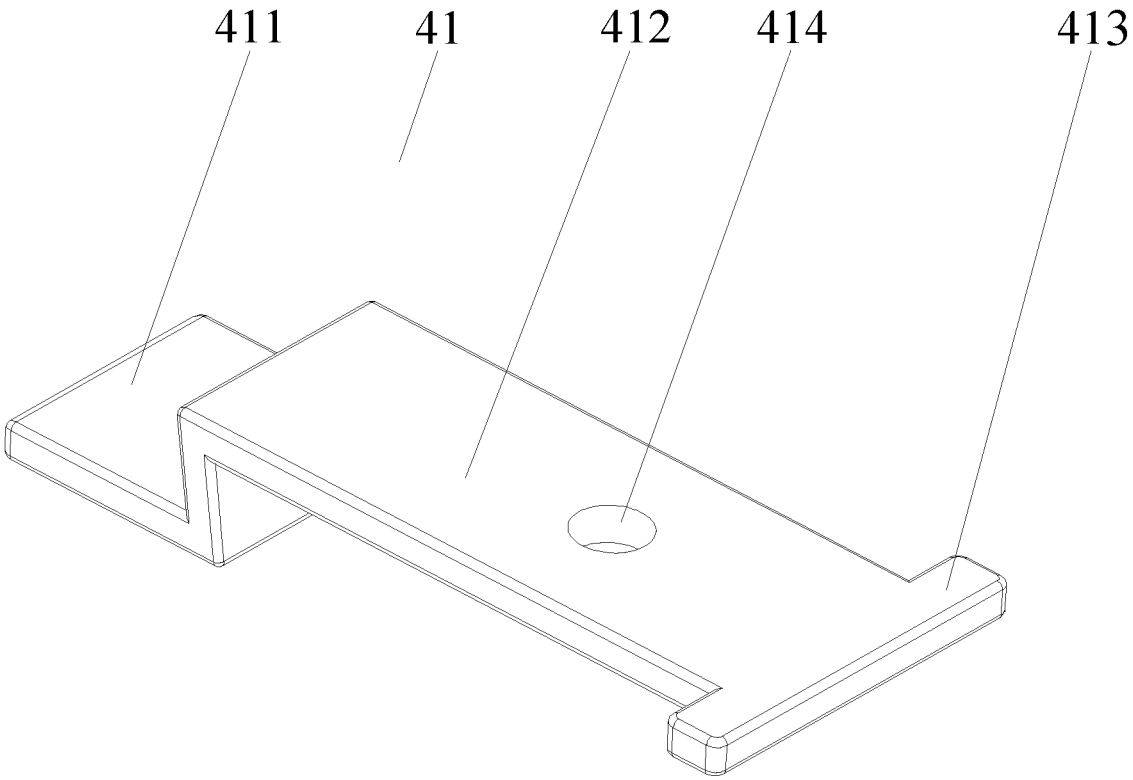
FIG. 4 is a structural view of the lock plate the present invention.
Figure 5:
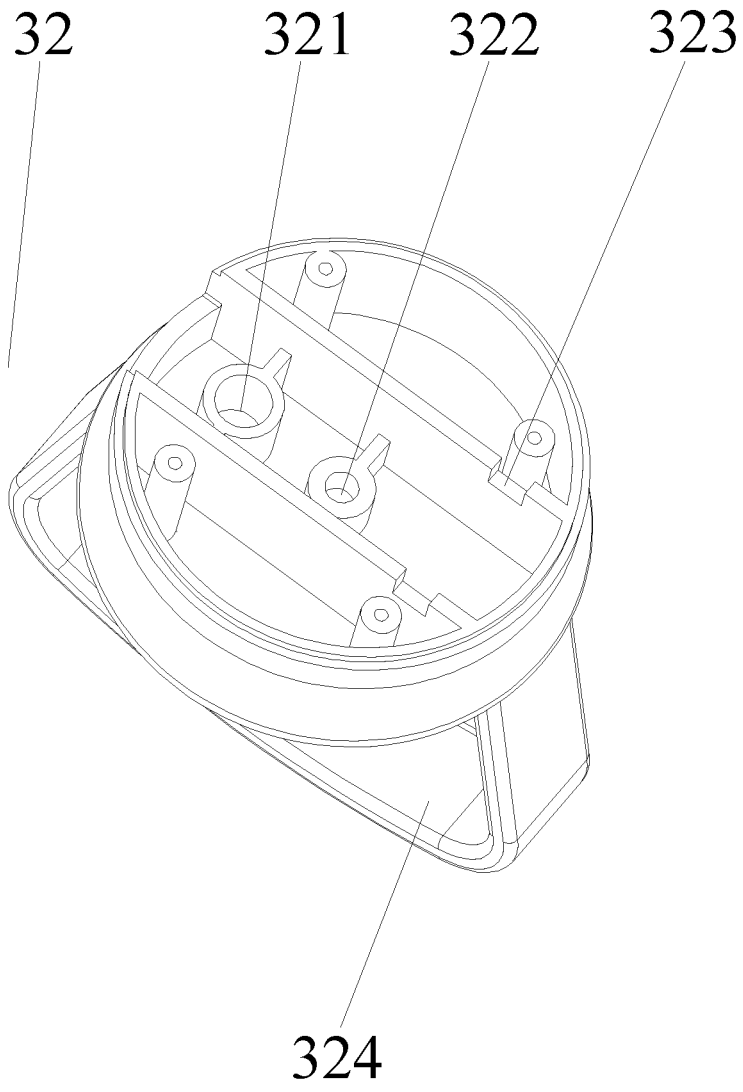
FIG. 5 is a structural view of the second lower disk unit of the present invention.
Figure 6:
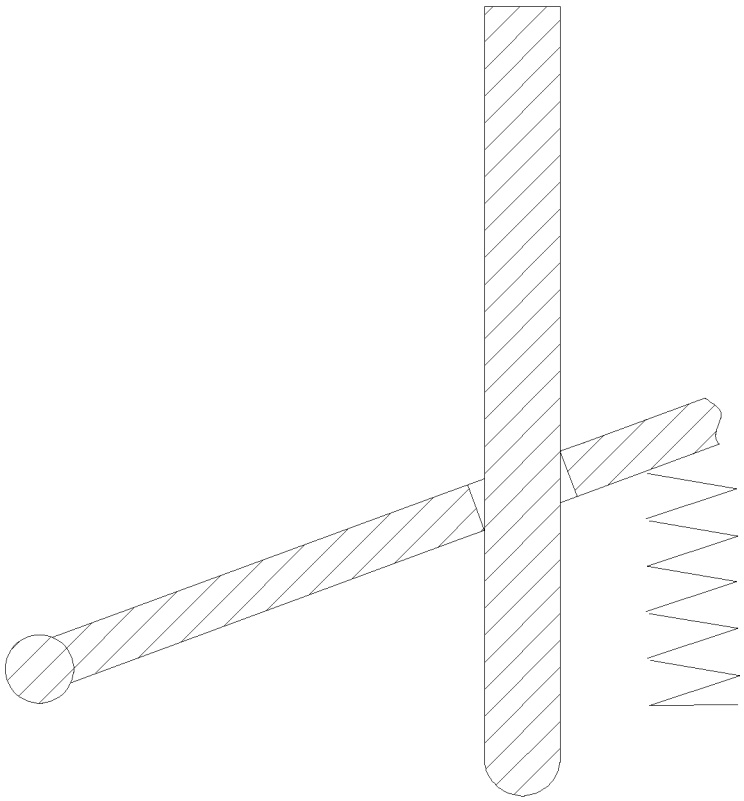
FIG. 6 is a structural view showing the locking state of the lock lever with the locking unit of the present invention.
Figure 7:
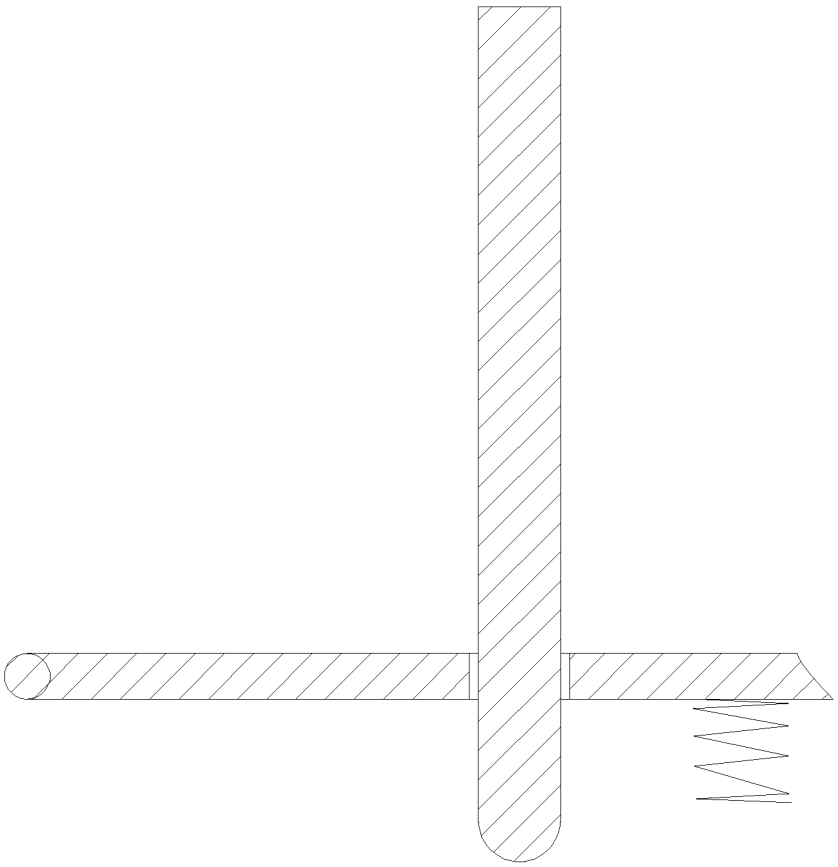
FIG. 7 is a structural view showing the unlocking state of the lock lever with the locking unit of the present invention.
Figure 8:
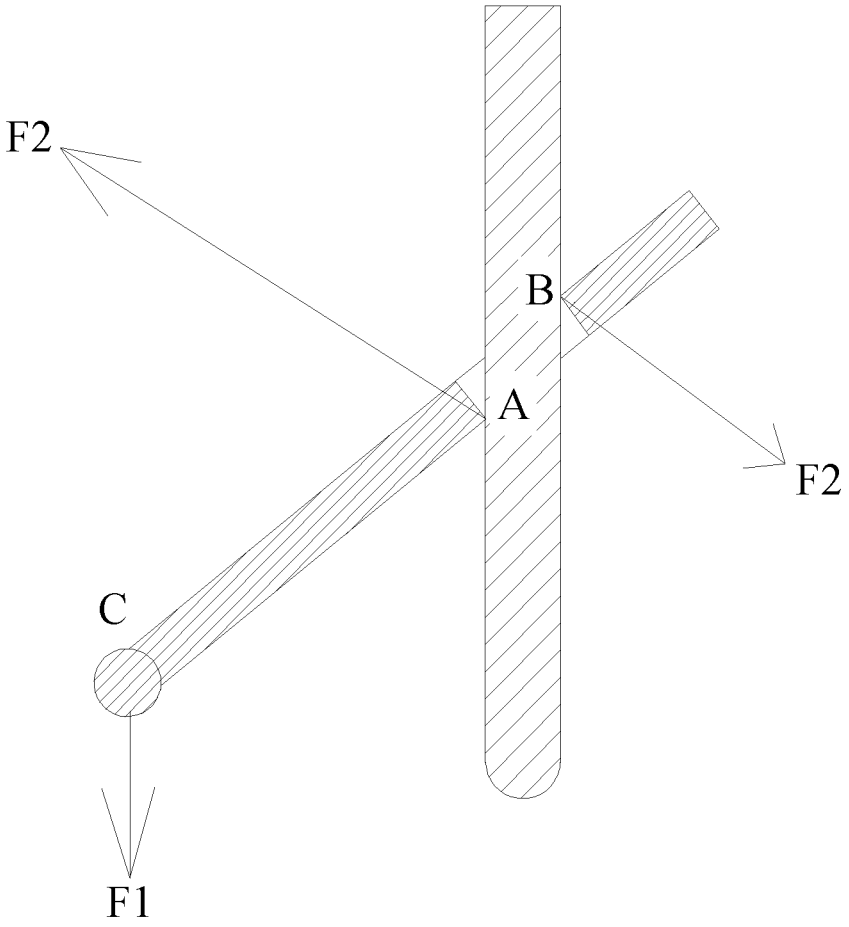
FIG. 8 is one structural view showing the forcing of the lock lever with the locking unit of the present invention.

Wherein: 1, top disk; 2, lock lever; 3, lower disk; 31, first lower disk unit; 311, lock lever guiding hole; 32, second lower disk unit; 321, mounting seat; 322, lock lever seat; 323, linkage groove; 324, pull ring; 33, mounting cavity; 34, button window; 4, locking unit; 41, lock plate; 411, button portion; 412, lock plate body; 413, linkage portion; 414, locking hole; and 42, elastic member.

DESCRIPTION OF THE EMBODIMENTS

In order to make the technical means, creative features, achievement goals and effects achieved by the present invention easy to understand, the present invention will be further described below in conjunction with specific illustrations.

As shown in FIGS. 1 to 9, the present embodiment discloses a folding canopy with central locking mechanism comprising a central locking mechanism, the central locking mechanism including a top disk 1, a lower disk 3 and a lock lever 2, the lower disk 3 including a locking unit 4, the locking unit 4 being used for cooperating with the lock lever 2. By means of the locking or unlocking of the locking unit 3 with the lock lever 2, it is possible to achieve the deployment or folding storage of the folding canopy.

Among which, a preferred structure of the locking unit 4 in the present embodiment is: the locking unit 4 includes a lock plate 41 and an elastic member 42. The lock plate 41 is provided therein with a locking hole 414, and the lock lever 2 is used to penetrate the locking hole 414. The elastic member 42 is used to cause the movement of the lock plate 41 for driving the locking hole 414 to tilt to a hole-tilted position. When the locking hole 414 is tilted to the hole-tilted position and a wall of the locking hole 414 is in frictional contact with a side wall of the lock lever 2, the central locking mechanism completes locking.

Preferably, in the present embodiment, when the lock plate 41 is not subjected to an external force, the lock plate body 412 is abutted by the elastic member 42 and is in a tilted state.

Preferably, when the locking unit 4 is in an unlocked state, the locking hole 414 is centered close to or overlaps a central axis of the lock lever 2, and when the locking unit 4 is in a locked state, the locking hole 414 is centered away from the central axis of the lock lever 2, wherein the central axis of the lock lever 2 contains its extension line portion.

Among which, the elastic member 42 preferably adopts a spring member, preferably a compression spring member. The elastic member 42 aims at allowing the lock plate 41 to be in a tilted state, so the elastic member 42 may also adopt other products having equivalent functions.

Further, in the present embodiment, the lock plate 41 includes a button portion 411, a lock plate body 412, and a linkage portion 413. The button portion 411 is wholly or partially located outside the lower disk 3, and the locking hole 414 is located on the lock plate body 412. One end of the elastic member 42 is used for abutting against the lock plate body 412, and the other end is cooperatively mounted to the lower disk 3. The linkage portion 413 is used for cooperatively mounting with the lower disk 3. The structure of the locking hole 414 is optimized, so that an upper opening thereof preferably adopts a trumpet-like structure to facilitate the penetration of the locking lever 2.

Among which, the button portion 411, the lock plate body 412 and the linkage portion 413 in the lock plate 41 may be an integral structure usually made of sheet metal stamping or an assembly structure design that may fitted with a metal ring at the locking hole with remaining parts injection-molded by plastic material, and the linkage portion may be a design of a hinged shaft structure.

In above description, the button portion 411 is generally partially exposed outside the lower disk 3, and the button portion 411 extends inwardly from the outside. The button portion 411 and the lock plate body 412 are usually connected by a connecting plate of an upright structure, usually a "Z" structure, wherein the bending part is a design of a right angle structure. The linkage portion 413 is located at the tail of the lock plate body 412, and the button portion 411 and the linkage portion 413 are respectively a head and a tail of the lock plate 41. The button portion 411 may move the lock plate body 412 in the mounting cavity 33 in a lifting manner.

Among which, the lower disk 3 may be divided into a first lower disk unit 31 and a second lower disk unit 32, so as to facilitate combination and mounting of the lock unit 4 with the lower disk 3. The first lower disk unit 31 and the second lower disk unit 32 are combined and assembled to form a mounting cavity 33 and a button window 34. The mounting cavity 33 is used for mounting to cooperate with the locking unit 4, and the button portion 411 is located at the button window 34 and extends to the outside. The button portion 411 may be pulled up and down at the button window 34.

Further, in the present embodiment, the first lower disk unit 31 is provided with a lock lever guiding hole 311, the lock lever guiding hole 311 is provided with a trumpet-shaped guiding hole wall, and the lock lever 41 is used to penetrate the lock lever guiding hole 311 and extends downward. The center of the lock lever guiding hole 311 overlaps with the central axis of the lock lever 2, the lock lever guiding hole 311 is located above the locking hole 414, and at least a portion of the cavity in the locking hole 414 is located directly below the lock lever guiding hole 311.

Preferably, one of the embodiments of the mounting structure of the locking unit 4 with the lower disk 3 is: the second lower disk unit 32 is provided with a linkage groove 323 and a mounting seat 321, the linkage groove 323 is used for cooperatively mounting with the linkage portion 413, and the mounting seat 321 is used for cooperatively mounting with the elastic member 42, wherein the mounting seat 321 is preferably a spring seat for facilitating the fixed cooperation between the bottom of the elastic member 42 and the mounting seat 321 while maintaining the deformable amount of the elastic member 42, and the maximum level of the mounting seat 321 shall not be higher than the height when the lock plate 41 is in the unlocked state. The lock plate 41 being in the unlocked state is the state where the wall of the locking hole 414 is detached from the wall of the lock lever 2, which may be preferably realized by making the lock plate body 412 in a horizontal state. Of course, the above horizontal state is not an absolute horizontal state, as long as the wall of the locking hole 414 is detached from the wall of the lock lever 2. In this structure, the linkage portion 413 and the linkage groove 323 may be designed into a hinged structure, or may be a directly movable engagement structure. The linkage 413 aims at providing the lock plate 41 with a rotatable pivot point, usually a force point C, which is combined and cooperated with the button portion 411 to tilt the lock plate body 412 for driving the locking hole 414 to tilt in the position.

Preferably, the material of the lock lever 2 is usually selected from aluminum alloy, steel pipe, plastic steel, existing modified plastic, etc. In order to improve the locking stability and service life of the lock lever 2 and the locking hole 414, the material of the side wall of the locking hole 414 is usually selected from aluminum alloy, steel pipe, plastic steel, existing modified plastic, etc.

Another embodiment of the mounting structure of the locking unit 4 and the lower disk 3 is: both the linkage groove and the mounting seat may be located on the first lower disk unit 31 and designed as an inverted structure. The mounting structure of the elastic member 42 with the lock plate 41 is similar to that described above.

Preferably, the second lower disk unit 32 is provided therein with a lock lever seat 322, and the lock lever seat 322 is used for accommodating an end of the lock lever 2. The lock lever 2 may be divided into a telescopic lock lever and a non-retractable lock lever, wherein the telescopic lock lever may adopt the structure of Patent No. CN206888665U in the background art, and the non-retractable lock lever is a single lever structure, such as the structure of Patent No. CN108026736A. The end of the telescopic lock lever may not be detached from the lower disk, and the end of the telescopic lock lever may be located at the lower part of the first lower disk unit 31 and may be extended and contracted relative to the first lower disk unit 31. The non-retractable lock lever may usually be detached from the lower disk 3. If the lock lever 2 is a non-retractable lock lever, the end thereof is generally designed as a hemispherical head structure for facilitating penetration through the lock lever guiding hole 311 and the locking hole 414.

Preferably, the second lower disk unit 32 is provided a pull ring 324 at the bottom for facilitating operation.

The operation process of the present invention is: The lock lever 2 is preferably a non-retractable lock lever. When the folding canopy is in a folded state, the folding canopy is opened, and the user lifts the lower disk 3 upwards. The lower disk 3 is gradually raised to the bottom end of the lock lever, and the lock lever 2 may be automatically guided by the lock lever guiding hole 311 to penetrate into the interior of the lower disk 3. Then, since a portion of the cavity of the locking hole 414 is located directly under the cavity of the locking lever guiding hole 311, the lock lever 2 may directly penetrate into the cavity of the locking hole 414 and sliding friction may occur between the side wall of the lock lever 2 and the wall of the locking hole 414, so that the lock plate 41 may be shifted downward with the upward thrust of the lower disk 3, causing the locking hole 414 to be always in a penetration state until the lock lever 2 is embedded in the lock lever seat 322. If unlocking is required, the lock lever 2 has to be disengaged from the locking hole 414, so the lock lever 2 is inevitably required to move upward or the lower disk 3 is moved downward, causing the side wall of the lock lever 2 to be in conflict with the wall of the locking hole 414, which gives a resistance to the lock plate 41, then, the lock plate 41 is always tilted due to the hole-tilted position relationship and the cavity wall relationship of the mounting cavity 33 inside the lower disk 3. Therefore, if there is no external force to interfere, the lock lever 2 may not move with the locking hole 414, thereby achieving forced lock-up, and therefore, the lock plate body 412 is driven to change the tilting angle and further the hole-tilted position of the locking hole 414 is driven to change by the interference of the button portion 411, pressing down the button portion 411, so that the lock lever 2 may be disengaged from the locking hole 414 to achieve detachment.

Another embodiment is: If the lock lever 2 is a telescopic lock lever structure, the size of the end of the lock lever 2 is larger than the minimum diameter of the lock lever guiding hole 311, and may telescopically penetrate through the locking hole 414. When in the folded state, the end of the lock lever 2 is located above the locking hole 414 and cooperates with the first lower disk unit 31. When unlocking is required, the lock lever 2 is shortened until it is shortened to a minimum unit, then the bottom end of the lock lever 2 penetrates through the locking hole 414, so that the locking or unlocking may be completed correspondingly by utilizing the frictional contact between the locking hole 414 and the lock lever 2, in combination with changing the related force relationship, referring to the locking principle for the non-retractable lock lever.

As shown in FIGS. 6 to 9, the locking principle of the present invention is: After the lock lever 2 penetrates into the locking hole 414 and completes the locking, an external force is required to be applied to the button portion 411 for unlocking if unlocking is required, and the locking force state of the locking hole 414 and the lock lever 2 in the lock plate body 412 may be referred to FIG. 8 if the button portion 411 is not subjected to external force. The lock plate 41 is equivalent to a lever. When the lower disk 3 is pulled down, since the locking hole 414 is tilted in the structure, two contact ends are formed between the wall of the locking hole 414 and the side wall of the lock lever 2, which may be divided into A and B. If unlocking is required, the lower disk 3 is inevitably required to be pulled down, so pulling-down of the lower disk 3 will form a downward force F1 on the lock plate 41, the force point of F1 is the connection part of the lock plate 41 and the lower disk 3, and is usually the mounting part C of the linkage portion 413 and the lower disk 3, thus two resistances F2 and F3 are bound to be formed at the two contact ends and the frictional force generated between the two may cause the locking hole 414 to complete the locking action on the lock lever 2. Through the force analysis of the lock plate body 412 with combination of the lock lever 2, if the locking hole 414 is always in the titled state, that is, there is frictional contact with the lock lever 2, the frictional contact has a certain static friction between the two. When the pulling force F1 required for unlocking is larger, the resistance formed by F2 and F3 is also larger, because the power arm of F1 is much larger than the resistance arms of F2 and F3. Therefore, unless the tilting state of the locking hole 414 is released such that the frictional interference between the locking hole 414 and the lock lever 2 is removed, the unlocking may be achieved. On the contrary, the greater the pulling force of the lower disk 3 for downward unlocking, the stronger the locking of the locking hole 414 with the lock lever 2 is.

Figure 9:
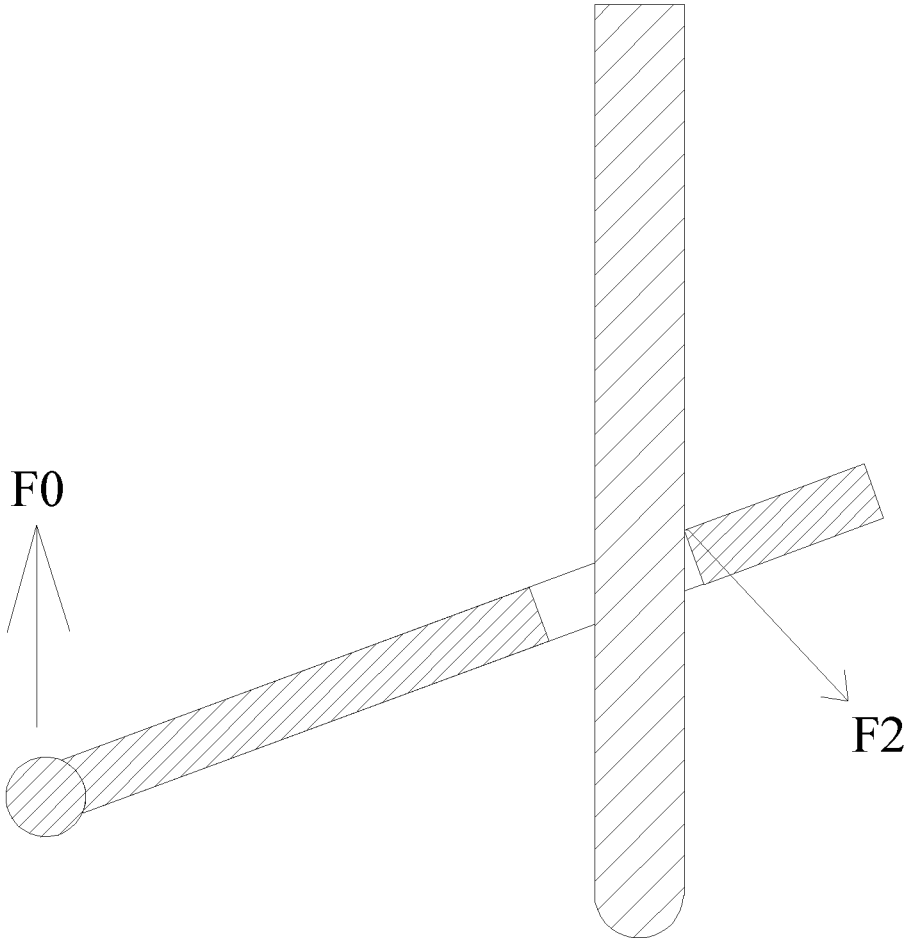
FIG. 9 is another structural view showing the forcing of the lock lever with the locking unit of the present invention.

As shown in FIG. 9, when the lower disk 3 is at the upward thrust F0, there is no downward pulling force F1 due to the contact of the locking hole 414 with the lock lever 2, thus two forces F2 and F3 at the contact end assist the locking hole to tend to reduce the tilting angle, the directions of the force of the two forces F2 and F3 are changed by the action of the thrust F0, and there is no force or detachment at the A and B ends, then the direction of the force is advantageous to enlarge the overlapping cavity area of the locking hole 414 and the lock lever 2, so as to facilitate insertion of the lock lever 2 into the locking hole 414.

The present invention adopts the design of the slotless lock lever structure, and utilizes the tilting of the lock plate to drive the locking hole to tilt to a hole-tilted position, so that the lock lever can be in frictional contact with the hole-tilted position, and the limitless locking can be realized by changing the force relationship between the lock lever and the locking hole. The structure has the characteristics of convenient operation, simple structure and stable locking.

It is apparent from the technical knowledge that the present invention can be implemented by other embodiments without departing from the spirit or essential characteristics thereof. Therefore, the above-disclosed embodiments are merely illustrative and not exclusive in all respects. All changes which are within the scope of the present invention or equivalent to the scope of the present invention are encompassed by the present invention.

What is claimed is:

1. A folding canopy with central locking mechanism, comprising a central locking mechanism; wherein the central locking mechanism has a top disk, a lower disk and a lock lever; the lower disk has a locking unit; the locking unit is configured for engaging with the lock lever; the locking unit has a lock plate and an elastic member; the lock plate is provided therein with a locking hole, and the lock lever is configured to penetrate the locking hole; the elastic member is configured for tilting the locking hole in the lock plate to a hole-tilted position; when the locking hole is tilted to the hole-tilted position and a wall of the locking hole is in frictional contact with a side wall of the lock lever, the central locking mechanism completes locking; and the elastic member is extended in a direction parallel to a central axis of the lock lever.

2. The folding canopy with central locking mechanism according to claim 1, wherein the lock plate has a button portion, a lock plate body, and a linkage portion; the button portion is wholly or partially located outside the lower disk, and the locking hole is located on the lock plate body; one end of the elastic member is configured for abutting against the lock plate body, and the other end of the elastic member is cooperatively mounted to the lower disk; and the linkage portion is configured for cooperatively mounting with the lower disk.

3. The folding canopy with central locking mechanism according to claim 2, wherein when the lock plate is not subjected to an external force, the lock plate body is abutted by the elastic member and is in a tilted state.

4. The folding canopy with central locking mechanism according to claim 3, wherein when the locking unit is in an unlocked state, the locking hole is centered close to or overlaps the central axis of the lock lever; and when the locking unit is in a locked state, the locking hole is centered away from the central axis of the lock lever.

5. The folding canopy with central locking mechanism according to claim 3, wherein the lower disk further has a first lower disk unit and a second lower disk unit; the first lower disk unit and the second lower disk unit are combined and assembled to form a mounting cavity and a button window; the mounting cavity is configured for mounting to cooperate with the locking unit, and the button portion is located at the button window and extends to outside of the lower disk; and the button portion is capable of being pulled up and down at the button window.

6. The folding canopy with central locking mechanism according to claim 2, wherein the lower disk further has a first lower disk unit and a second lower disk unit; the first lower disk unit and the second lower disk unit are combined and assembled to form a mounting cavity and a button window; the mounting cavity is configured for mounting to cooperate with the locking unit, and the button portion is located at the button window and extends to outside of the lower disk; and the button portion is capable of being pulled up and down at the button window.

7. The folding canopy with central locking mechanism according to claim 6, wherein the button portion is capable of driving the lock plate body to move in the mounting cavity.

8. The folding canopy with central locking mechanism according to claim 6, wherein the first lower disk unit is provided with a lock lever guiding hole, and the lock lever guiding hole is provided with a trumpet-shaped guiding hole wall; and the lock lever is configured for penetrating the lock lever guiding hole and extending downward.

9. The folding canopy with central locking mechanism according to claim 6, wherein the second lower disk unit is provided with a linkage groove and a mounting seat, the linkage groove is configured for cooperatively mounting with the linkage portion, and the mounting seat is configured for cooperatively mounting with the elastic member.

10. The folding canopy with central locking mechanism according to claim 6, wherein the second lower disk unit is provided therein with a lock lever seat; and the lock lever seat is configured for accommodating an end of the lock lever.

11. The folding canopy with central locking mechanism according to claim 6, wherein the second lower disk unit is provided a pull ring at bottom of the second lower disk unit.

12. The folding canopy with central locking mechanism according to claim 2, wherein when the locking unit is in an unlocked state, the locking hole is centered close to or overlaps the central axis of the lock lever; and when the locking unit is in a locked state, the locking hole is centered away from the central axis of the lock lever.

13. The folding canopy with central locking mechanism according to claim 1, wherein when the locking unit is in an unlocked state, the locking hole is centered close to or overlaps the central axis of the lock lever; and when the locking unit is in a locked state, the locking hole is centered away from the central axis of the lock lever.

* * * * *